United States Patent [19]

Matsumoto et al.

[11] Patent Number: 4,507,002

[45] Date of Patent: Mar. 26, 1985

[54] PRINTING TIMING CORRECTION DEVICE IN SHUTTLE TYPE DOT LINE PRINTER

[75] Inventors: Hisayoshi Matsumoto, Tokorozawa; Takahiko Fukuzawa, Hoya, both of Japan

[73] Assignee: Citizen Watch Co., Ltd., Tokyo, Japan

[21] Appl. No.: 554,827

[22] Filed: Nov. 23, 1983

[30] Foreign Application Priority Data

Nov. 26, 1982 [JP] Japan ..... 57-207980

[51] Int. Cl.[3] ..... B41J 19/30

[52] U.S. Cl. ..... 400/322; 101/93.04; 101/93.09; 400/121; 400/320; 400/328

[58] Field of Search ..... 101/93.04, 93.05, 93.09; 400/121, 124, 320, 322, 323, 328

[56] References Cited

U.S. PATENT DOCUMENTS 4,020,939 5/1977 Quaif et al. ..... 400/124
4,024,941 5/1977 Sekikawa et al. ..... 400/124
4,076,111 2/1978 Robinson et al. ..... 400/124
4,116,567 9/1978 San Pietro ..... 101/93.05 X
4,119,383 10/1978 Watanabe et al. ..... 400/320 X
4,180,334 12/1979 Watanabe et al. ..... 400/124

*Primary Examiner*—Paul T. Sewell
*Attorney, Agent, or Firm*—Koda and Androlia

[57] ABSTRACT

A printing timing correction device in a shuttle type dot line printer wherein a shuttle is reciprocated in directions perpendicularly intersecting a direction of feeding printing paper, printing needles regularly arranged on the shuttle are projected to recording paper to thereby conduct desirable printing operations and the shuttle performs non-constant velocity motion for which the rotation of a driving motor is transmitted by a crank mechanism.

The printing timings are varied against the printing needles performing non-constant velocity motion in accordance with the speed of the printing needles, whereby the printings are performed at equal interval positions on the printing paper. This correction is performed by varying the delay time periods of signals fed to the printing needle driving device.

5 Claims, 4 Drawing Figures

PRINTING TIMING CORRECTION DEVICE IN SHUTTLE TYPE DOT LINE PRINTER

BACKGROUND OF THE INVENTION

1. Field of the Invention

This invention relates to a printing timing correction device in a shuttle type dot line printer, and more particularly to an improved printing timing correction device in the shuttle type dot printer wherein a shuttle including a plurality of printing needles is oscillated in directions perpendicularly intersecting a direction of feeding printing paper.

2. Description of the Prior Art

There have heretofore been known dot printers, in each of which printing needles are projected to printing paper in accordance with predetermined printing data and desirable characters, signs and others are formed by a plurality of dots, being used as various output printing devices for information processing machines. Furthermore, there have been known as dot line printers, in each of which the above-described dot printer is further improved such that a plurality of printing needles are arranged at equal intervals in a line on the printing paper, while the printing needles are reciprocated across a needle pitch the paper feed is effected in a direction perpendicular to the directions of the reciprocation, to thereby conduct desired printing operations successively. The dot line printer is advantageous in that it can carry out the printing operations at very high speed and in large quantities as compared with a serial type dot printer. Since an oscillating portion reciprocating across a needle pitch, in which a plurality of printing needles are arranged, is referred to as a shuttle, the above-described printer is known as a shuttle type dot line printer.

FIG. 1 shows the conventional example of the shuttle type dot line printer of the type described, in which a platen 26 is rotatably supported by side walls 22 and 24 affixed to a base frame 20, and recording paper is placed along the surface of the platen 26. The recording paper is click-feedingly supported at opposite end edges thereof by paper feed receivers 30 and 32 and paper feed-driven by the rotation of a feed shaft 34 in the direction indicated by an arrow mark A.

The base frame 20 is provided thereon with a shuttle 36 reciprocatorily supported in directions B–C perpendicularly intersecting the aforesaid direction A for paper feeding. On the shuttle 36, there are regularly arranged a plurality of printing needles projecting to the recording paper 28, and these printing needles corresponding to predetermined positions are adapted to project to the recording paper in operational association with the reciprocatory motions of the shuttle 36, whereby simultaneous printing in a direction of a line are conducted on the recording paper 28 through a ribbon or the like. Although the construction of the respective printing needles 10 and a solenoid driving device are not shown in detail in the drawing, the arrangement similar to that of the normal dot printer is provided for each of the printing needles.

To reciprocate the shuttle 36 in the directions B–C, a driving motor 38 consisting of a DC motor or the like is affixed to the base frame 20, and a flywheel 40 is solidly secured to a shaft of the motor. A crankshaft, not shown, is provided in front of the flywheel 40. One end of a connecting rod 42 is engaged with the crankshaft and the other end thereof is engaged with the shuttle 36 through a shaft 44, so that it is readily understood that the shuttle 36 can be reciprocated in the directions B–C through a crank mechanism including the connecting rod 42 in accordance with the rotation of the driving motor 38.

The shuttle 36 includes therein a plurality of printing needles and printing needle actuators for driving the printing needles, and these driving portions are integrated into a hammer bank. The hammer bank is comparatively large in weight and its inertial force is high during the operation of the driving motor, whereby the hammer bank tends to cause unnecessary vibrations and the like to the device itself. To absorb the inertial force, the device is provided with a counterweight 46 reciprocating in a direction opposite to that of the shuttle 36. The counterweight 46 is connected to the aforesaid crankshaft through a second connecting rod 48, whereby the shuttle 36 and the counterweight 46 move in directions opposite to each other, and the inertial force and the reaction force caused by an acceleration offset each other through the utilization of the reaction forces of the both members, so that the vibrations are prevented from being caused to the device itself. The shuttle 36 and the counterweight 46 are respectively supported in their movements in the directions B–C by receiving bases 50 and 52 affixed to the base frame 20.

A slit disc 54 affixed to the tail end of the motor 38 electrically, accurately detects a position in the reciprocatory motion of the shuttle 36 in cooperation with a photointerruptor 56.

As apparent from the aforesaid FIG. 1, the shuttle 36 is reciprocated in the directions B–C by the crank mechanism, with the result that the reciprocatory motion of the shuttle 36 becomes a non-constant velocity motion as against the motor 38 performing a constant velocity motion. As it stands, it becomes difficult to accurately set the printing timing of the printing needles. Therefore, with the conventional device, there has been a problem that a compensating mechanism should be provided which mechanically correct the above-described non-constant velocity motion, so that the shuttle 36 can reciprocate at a constant speed. Because of this, the device is rendered large-sized and increased in manufacturing cost. Furthermore, in FIG. 1, a special cam configulation is required for the engagement between the connecting rods 42, 48 and the shaft of the motor 38. In that case, there has been presented the disadvantage that the working and the positioning at the time of assembling are quite troublesome.

SUMMARY OF THE INVENTION

The present invention has been developed to obviate the above-described disadvantages of the prior art and has as its object the provision of a printing timing correcting device in a shuttle type dot line printer, wherein the projecting printing timing of the printing needles is electrically delay-controlled, leaving the reciprocatory motion of the shuttle as the non-constant velocity motion, so that the printing at a correct pitch can be carried out.

To this end, the present invention contemplates that, in a shuttle type dot line printer wherein a shuttle is reciprocated in directions perpendicularly intersecting a direction of feeding printing paper, printing needles regularly arranged on the shuttle are projected to recording paper to thereby conduct desirable printing operations and the shuttle performs non-constant velocity motion for which the rotation of a driving motor is transmitted by a crank mechanism, the printer includes: a motor timing sensor for electrically detecting the rotational phase of the driving motor as equal interval pulses; a timing correcting memory for storing timing correcting values for correcting the non-equal interval phase of the shuttle against the rotational phase of the motor per printing timing; an address counter for successively reading out the timing correcting values from the timing correcting memory; and a delay timing correcting circuit for outputting printing timing signals corrected in accordance with the timing correcting values of the timing correcting memory to a printing needle driving device of the shuttle; and the address counter is successively renewed by the equal interval phases detected from the motor timing sensor, delay time periods of the delay timing correcting circuit are set in accordance with the timing correcting values stored in the timing correcting memory per printing timing, and printing timing signals are outputted for control at equal interval positions on the printing paper in accordance with the non-constant velocity motion of the shuttle.

DETAILED DESCRIPTION OF THE PREFERRED EMBODIMENT

Description will hereunder be given of a preferred embodiment of the present invention with reference to the drawings.

Figure 1:
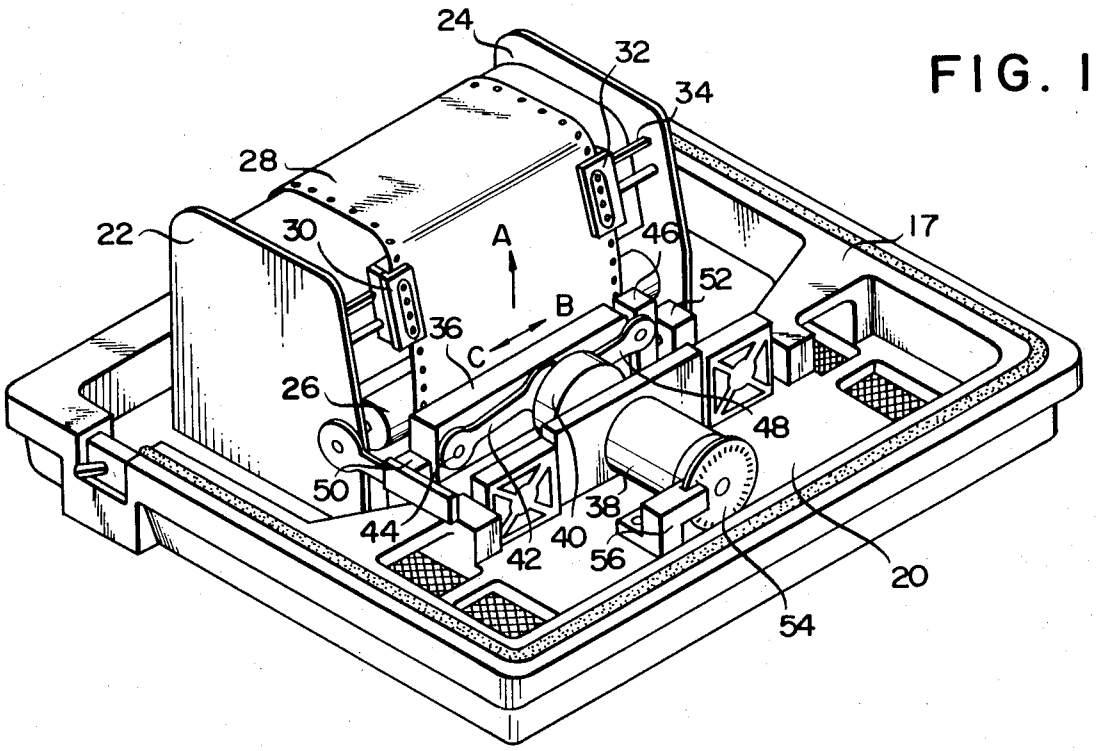
FIG. 1 is a schematic perspective view showing the shuttle type dot line printer to which the present invention is applied.
Figure 2:
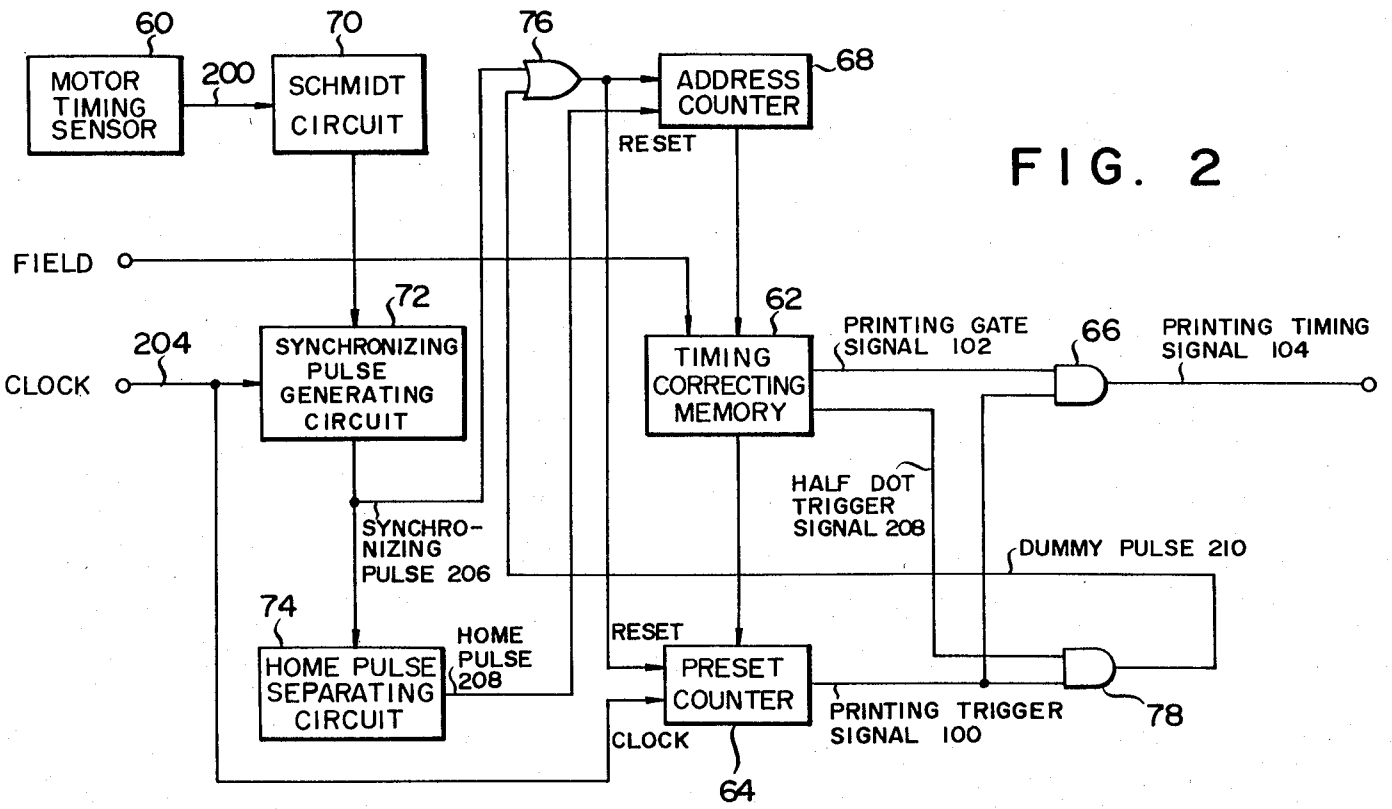
FIG. 2 is a block diagram showing the timing correcting circuit to which the present invention is applied.

The printing timing correction device shown in FIG. 2 includes a motor timing sensor 60 having an arrangement similar to that including a slit disc, a photointerruptor and the like in the conventional device. Equal pulses of the motor outputted from the motor timing sensor 60 are processed to effect control of the delay-corrected printing timing signals to the printing needle driving device.

Figure 3:
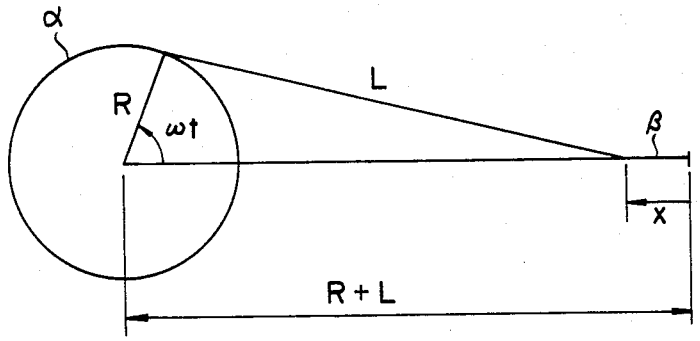
FIG. 3 is a view of the principle of the present invention.

FIG. 3 shows the principle of correcting the timing according to the present invention, in which the crank mechanism including a crank R and an arm L converts a constant-velocity circular motion indicated by reference character $\alpha$ into a reciprocatory motion indicated by reference character $\beta$, and a reciprocatory movement value x at this time can be obtained from a crank length R, an arm length L and an angular velocity $\omega$ of the rotational motion $\alpha$.

More specifically, in FIG. 3, the crank R performing a constant-velocity circular motion is converted into a rectilinear displacement x of the shuttle through the arm L and it is readily understood that, from the geometrical arrangement in the drawing, the aforesaid displacement x of the shuttle may be obtained from the following equation of relationship.

$$x = R + L - R \cdot (\cos \omega t - \sqrt{L^2 - (R \cdot \sin \omega t)^2} \quad (1)$$

Here, when L is infinity and R is zero, $x = R \cos \omega t$. Hence, according to the present invention, if L is made large and R is made small, the an approximate sinusoidal wave curve motion is obtainable.

According to the present invention, the aforesaid angular velocity $\omega$ is obtainable from a detection signal outputted from the motor timing sensor 60, and the position of the shuttle can be calculated in response to an output from the sensor (namely, equal interval pulses at this time indicate the position of the crank R).

As apparent from FIG. 2, in the embodiment, there is provided a timing correcting memory 62 which performs calculations in accordance with the aforesaid equation (1) and outputs printing timing signals which have been subjected to predetermined delay process at the respective printing positions. In the embodiment, the timing correcting memory 62 stores the delay timing correcting values at the respective printing positions in the moving direction of the shuttle, and these correcting values are previously calculated in accordance with the aforesaid equation (1). Actually, this timing correcting memory 62 consists of a read only memory and predetermined read only memories are desirably replaced with one another depending upon the type of the dot line printer and use conditions, so that desirable printing timing corrections can be conducted.

The timing correcting values of the timing correcting memory 62 causes the delay timing correcting circuit to perform a predetermined delay process, whereby the printing needle driving device is driven in response to printing timing signals outputted from the delay timing correcting circuit. The delay timing correcting circuit in the embodiment consists of a preset counter 64, to which are fed the aforesaid timing correcting values as preset values, and, upon completion of counting of the preset values, the printing timing signal is outputted for control.

More specifically, a predetermined, selected timing correcting value is fed from the timing correcting memory 60 to the preset counter 64 after the preset counter is reset, whereby the timing correcting value thus fed is preset in the preset counter 64 as the preset value, and a signal is outputted from the preset counter 64 when clock signals fed to a clock input terminal of the counter 64 reaches the preset value. And, a printing trigger signal 100 outputted from the preset counter 64 together with a printing gate signal 102 from the timing correcting memory 62 are fed to an AND gate 66, and, when the both signals correspond with each other, a printing timing signal 104 is fed to a printing needle driving device, not shown.

To read out the timing correcting values predetermined per printing in the timing correcting memory 62, the memory 62 is connected thereto with an address counter 68, and, to successively, renewingly instruct the read-out control of this address counter 68 corresponding to the printing positions of the shuttle, outputs from the aforesaid motor timing sensor 60 are utilized.

Figure 4:
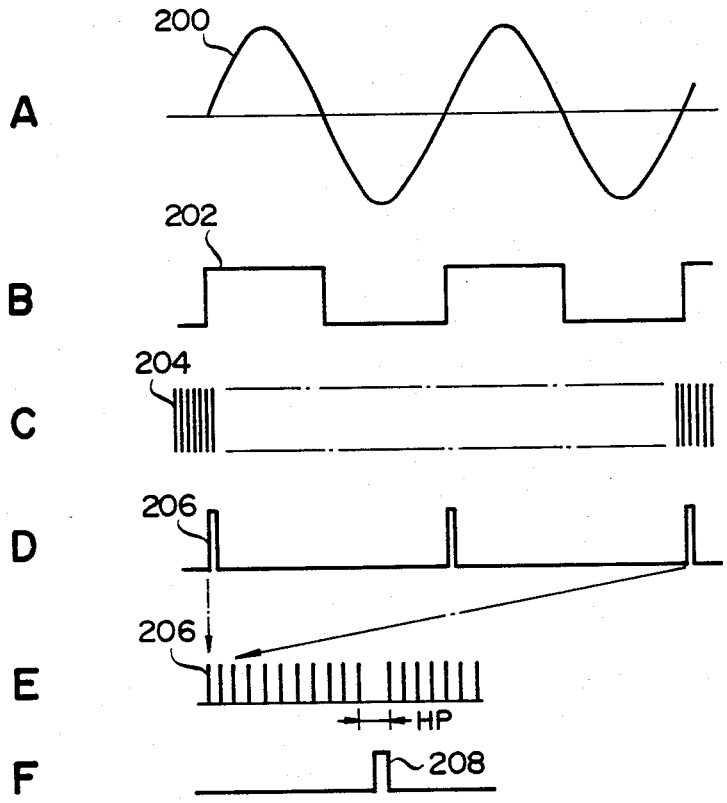
FIG. 4 is a timing chart of FIG. 2.

As shown in FIG. 4A, the outputs from the motor timing sensor 60 are formed substantially sinusoidal wave shape determined by the photoelectric conversion characteristics, and the equal interval pulses 200 thereof are converted into shaped waves 202 by a Schmidt circuit 70 as shown in FIG. 4B, further, compared with clock signals 204 in a pulse generating circuit 72 as shown in FIG. 4C, and synchronizing pulses 206 corresponding to the initial positions of the aforesaid shaped waves 202 are outputted as shown in FIG. 4D. These synchronizing pulses 206 correspond to the outputs from the motor timing sensor 60, namely, indicate the rotational phase of the motor. In consequence, if the rotational speed of the motor is constant, the pulse cycle of the synchronizing pulses 206 comes to be at a constant value. This is because, as for the position of the shuttle, there is included an error shown in the aforesaid equation (1), and hence, in order to accurately control the printing timing, it becomes necessary to make the aforesaid correction.

Furthermore, the synchronizing pulses 206 include a signal for indicating a home position in the rotational phase of the motor, i.e., a home position of the shuttle itself for making one turn of the motor correspond to one reciprocatory cacle of the shuttle in the normal case, and a home pulse separating circuit 74 is provided for separating the home pulses from other synchronizing pulses.

In the embodiment, slits differing in width from other slits are partially formed in the slit disc of the motor timing sensor 60, i.e., a pulse pitch is twice that of others in a region HP corresponding to the home position in FIG. 4E where the aforesaid synchronizing pulses 206 are reduced in size, so that the home pulses 208 can be readily separated from other synchronizing pulses 206.

Then, the home pulses 208 are fed to a reset input terminal of the address counter 68, whereby the address counter 68 is reset to the initial position in the home position of the shuttle.

Subsequently, when the device starts operation from this initial position and the shuttle moves to the next printing position due to the rotation of the motor, a synchronizing circuit 72 outputs the synchronizing pulses 206 at a stage before this corresponding printing position, and these synchronizing pulses 206 are fed to the address counter 68 through an OR gate 76, whereby the read-out address is successively renewed. In consequence, the address counter 68 reads out the timing correcting value of the timing correcting memory 62 by use of an address thus renewed, and the timing correcting value thus read out is preset in the address counter 64. Since the address counter 64 has been reset by the synchronizing pulses 206, if the aforesaid timing correcting value is preset, then, simultaneously, the down count is performed by the clock signal 204, and, when the content of the count becomes "zero", the printing trigger signal 100 is emitted. The period of time required for this count is set to the delay time period determined in the aforesaid equation (1), whereby, when the printing trigger signal 100 is outputted, the shuttle is to reach the correct printing position. In consequence, the printing trigger signal 100 together with the printing gate signal 102, which has been previously outputted from the timing correcting memory 62, are passed through the AND gate 66 and outputted as a printing timing signal 104, and actuate a desirable printing needle driving device, so that the dot printing operation can be performed at a correct position.

The above-described delaying operation is repeated such that, in response to the equal interval pulses detected from the motor timing sensor 60, the preset counter 64 is successively reset, the address counter 68 is renewed, the timing correcting values in the timing correcting memory 62 are preset, and delayed printing trigger signal is outputted from the counter 64, whereby accurately delay-controlled printing timing signal 104 is outputted per predetermined printing position.

In consequence, it is readily understood that, regardless of that the shuttle itself performs non-constant velocity motion, the actual printing needle driving is accurately controlled at an equal pitch by use of a circuit arrangement which has been subjected to a simple digital process.

In the embodiment shown in FIG. 2, to further conduct the high density printings such as half dots, quarter dots and the like, there is added a circuit capable of conducting the printing at an interval narrower than the pulse interval of the aforesaid synchronizing pulses 206. More specifically, the printing trigger signal 100 from the preset counter 64 together with a half dot trigger signal 208 from the timing correcting memory 62 are fed to an AND gate 78, whereby dummy pulses 210 outputted from this AND gate 78 are fed to an OR gate 76 disposed at the input side of the aforesaid address counter 68.

In consequence, when the printing trigger signal 100 is outputted from the preset counter 64, if the aforesaid half dot printing is conducted, then a half dot trigger signal 208 is outputted from the timing correcting memory 62, whereby, at this time, the output 100 from the preset counter 64 is fed to the address counter 68 as the dummy pulses 210, and, in place of the synchronizing pulses 206, the dummy pulses 210 renew the address counter 68. In consequence, regardless of that the equal interval pulses 200 are not emitted from the motor timing sensor 60, the address counter 68 feeds the timing correcting value to the preset counter 64, whereby the operation similar to the above is performed, so that half dots disposed at the intermediate positions between the normal dot intervals can be printed. Needless to say, during the half dot printing, the data from the timing correcting memory 62 are also selected for the half dot printing, so that desirable high density printing can be conducted.

As has been described hereinabove, the present invention can provide a shuttle type dot line printer wherein desirable dot printing can be conducted at an accurate pitch while non-constant velocity motion of the shuttle driven by the motor is allowed, construction of the crank mechanism for converting the rotation of the motor into the reciprocatory motion is simplified to a considerable extent, the complicated cam configuration can be eliminated, the mechanical construction thereof is compact and simplified, and the manufacturing cost is low.

What is claimed is:

1. A printing timing correction device in shuttle type dot line printer wherein a shuttle is reciprocated in directions perpendicularly intersecting a direction of feeding printing paper, printing needles regularly arranged on said shuttle are projected to recording paper to thereby conduct desirable printing operations and said shuttle performs non-constant velocity motion for which the rotation of a driving motor is transmitted by a crank mechanism, characterized in that said printer comprises:

a motor timing sensor for electrically detecting the rotational phase of said driving motor;

a timing correcting memory for storing timing correcting values for correcting the non-equal interval phase of said shuttle against the rotational phase of said motor per printing timing;

an address counter for successively reading out the timing correcting values from the timing correcting memory; and a delay timing correcting circuit for outputting printing timing signals corrected in accordance with the timing correcting values of said timing correcting memory to a printing needle driving device of said shuttle;

and said address counter is successively renewed by the equal interval pulses detected from said motor timing sensor, delay time periods of the delay timing correcting circuit are set in accordance with the timing correcting values stored in said timing correction memory per printing timing, and printing timing signals are outputted for control at equal interval positions on the printing paper in accordance with the non-constant velocity motion of said shuttle.

2. A printing timing correction device in shuttle type dot line printer as set forth in claim 1, wherein said timing correcting memory comprises a replaceable read only memory.

3. A printing timing correction device in shuttle type dot line printer as set forth in claim 1, wherein said delay timing correcting circuit comprises a preset counter, timing correcting values are fed to a preset input terminal of said preset counter, a printing trigger signal is outputted from said preset counter when the count value reaches a preset value, and a printing timing signal is fed to said printing needle driving device in response to said printing trigger signal and a printing gate signal from said timing correcting memory.

4. A printing timing correction device in shuttle type dot line printer as set forth in claim 1, wherein said printer is provided with a home pulse separating circuit for processing equal interval pulses detected from said motor timing sensor to separatingly extract a home position of said shuttle.

5. A printing timing correction device in shuttle type dot line printer as set forth in claim 1, wherein said printer includes a circuit for forming dummy pulses to conduct half dot printing.

* * * * *